US006209524B1

(12) United States Patent
Itoh

(10) Patent No.: US 6,209,524 B1
(45) Date of Patent: Apr. 3, 2001

(54) FUEL-INJECTION APPARATUS

(75) Inventor: Tomoyuki Itoh, Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/340,170

(22) Filed: Jun. 28, 1999

(30) Foreign Application Priority Data

Jun. 30, 1998 (JP) ..... 10-184583

(51) Int. Cl.[7] ..... F02M 41/00
(52) U.S. Cl. ..... 123/467; 239/124
(58) Field of Search ..... 123/467, 456; 239/124, 88, 90, 95, 96, 102.2, 533

(56) References Cited

U.S. PATENT DOCUMENTS

| | | | | |
|---|---|---|---|---|
| 4,941,613 | * | 7/1990 | Hardy et al. | 239/124 |
| 5,205,492 | * | 4/1993 | Khinchuk | 239/533.4 |
| 5,560,549 | * | 10/1996 | Ricco et al. | 239/533.8 |
| 5,692,476 | * | 12/1997 | Egler et al. | 123/456 |
| 6,062,489 | * | 5/2000 | Tokumaru | 239/124 |

FOREIGN PATENT DOCUMENTS 10-077924 3/1998 (JP) .

* cited by examiner

*Primary Examiner*—Henry C. Yeun
*Assistant Examiner*—Mahmoud M Gimie
(74) *Attorney, Agent, or Firm*—Browdy and Neimark

(57) ABSTRACT

A fuel-injection apparatus is disclosed, in which a valve stem and a valve body for an actuator-operated valve are formed separately from each other whereby the valve body may be made less in its pressure-exposed area, resulting in reducing the force for opening the valve upon valve-opening phase. The valve stem and the valve body, formed separately, may be made less in their diameter whereby less fuel pressure acting on the valve may be sufficient. This makes it possible to reduce the force for opening the valve upon valve-opening phase. The valve stem and the valve body are united into the valve by the application of a reinforcing plate onto the bottom ends of them. The valve body is provided on a valve face thereof with an annular groove concentric with a central hole, and radial grooves extending radially outwardly from the annular groove. The fuel pressure in a balance chamber may be introduced in the annular groove and the consequent fuel pressure in the annular groove exerts force acting on the valve body in a direction of valve opening, whereby the valve may be opened with small force.

3 Claims, 6 Drawing Sheets

FUEL-INJECTION APPARATUS

BACKGROUND OF THE INVENTION

1. Field of the Invention

The present invention relates to a fuel-injection apparatus adapted to direct-injection engines.

2. Description of the Prior Art

Of the various fuel-injection apparatus that have been conventionally developed, for example, the pressure-accumulated, fuel-injection apparatus is widely used, in which fuel stored in the common rail under pressure is injected into the combustion chambers by the closure and open of the solenoid-operated valves provided on the heads of the injectors. A fuel-injection apparatus, for example, shown in FIG. 5, has a needle valve 59 that is movable in a nozzle body 57 for a reciprocating manner to open and close discharge orifices 58 at the tip of the nozzle body 57, the needle valve 59 being constantly urged by the action of a closing spring 60 to close the discharge orifices 58.

The nozzle body 57 is provided therein with a fuel passage 62 for allowing the fuel fed under high pressure from the common rail to flow into a fuel sac 61, a fuel passage 64 for allowing the fuel fed under high pressure from the common rail to flow into a balance chamber 63, a fuel passage 67 for communicating the balance chamber 63 with a space 66 containing therein a solenoid-operated valve 65 to open and close the fuel passage 67, a fuel-leak passage 70 for communicating the space 66 with an intermediate chamber 69 surrounding around a slender section 68 of the needle valve 59, and a fuel discharge passage 71 for communicating the space 66 to a fuel reservoir.

The needle valve 59 has upper and lower sections arranged on the axially opposing end of the spender section 68, the upper section being made greater in diameter, compared with the lower section. The needle valve 59 is subjected to the hydraulic pressure, or fuel pressure, of the high-pressure fuel forced into the fuel sac 61, which acts so as to open the discharge orifice 58, and at the same time subjected to the resultant force of the urging force of the closing spring 60 and the fuel pressure of high-pressure fuel in the balance chamber 63, which acts so as to close the discharge orifice 58. As the intermediate chamber 69 is exposed to the low fuel pressure acting through the fuel-leak passage 70, the high-pressure fuel in the fuel sac 61 and balance chamber 63 may leak out through a clearance between the confronting needle valve 59 and the nozzle body 57. The fuel leaked out in the intermediate chamber 69 is collected in the reservoir through the fuel-leak passage 70, intermediate chamber 66 and fuel discharge passage 71.

When energizing the solenoid-operated valve 65, a valve body 72 of the solenoid-operated valve 65 is attracted to an electromagnet against an elastic force of a return spring 73. At this event, the fuel passage 67 is open to the space 66 whereby the balance chamber 63 is relieved through the fuel passage 67, resulting in the reduction in the fuel pressure therein. The force of fuel pressure acting on the fuel sac 61 is designed greater than the resultant force of the force of fuel pressure acting on the balance chamber 63 with the spring force and, therefore, the needle valve 59 moves upwards, resulting in opening the discharge orifice 58 as shown in FIG. 5. In contrast, when deenergizing the solenoid-operated valve 65, the valve body 72 moves downwards by the action of the return spring 73 to thereby close the space 66 at the fuel passage 67. As a result, the resultant force of the elastic force of the spring 60 with the force of fuel pressure restored in the balance chamber 63 becomes greater than the force of fuel pressure acting in the fuel sac 61 to make the needle valve 59 move downwards thereby closing the discharge orifice 58.

On the fuel-injection apparatus as described above, however, the fuel leaks constantly out from the intermediate chamber 69 through the fuel passage 67, namely, the fuel is constantly under the static leakage, in addition to that the fuel leaks out from the balance chamber 63 to the space 66 through the fuel passage 67 at every actuation of the solenoid-operated valve 65. Moreover, as seen from FIG. 6, the amount of static leakage of fuel increases with the increase of the common rail pressure. That is to say, as the pressure in the intermediate chamber 69 is constantly under the low pressure or the atmospheric pressure, the increase of the fuel pressure results in increasing the amount of the leakage of fuel from the fuel sac 61 and balance chamber 63 to the intermediate chamber 69 through the clearance between the confronting needle valve 59 and nozzle body 57.

To cope with the problem as described just above, a fuel-injection apparatus was developed, which is disclosed in Japanese Patent Laid-Open No.77924/1998. The fuel-injection apparatus, as apparent from FIG. 7, has for its object to make sealing with the use of fuel pressure and is comprised of a body having fuel-discharge orifice equivalent to the reference number 58, a needle valve 75 movable in a space 74 in the body in a reciprocating manner so as to open and close at its one axial end the fuel-discharge orifice, a balance chamber 76 in which the needle valve 75 is exposed at its axially opposite end serving as a pressure-supporting face to control the amount of lift of the needle valve 75, a fuel-supply passage 77 for applying the fuel pressure to the balance chamber 76, a fuel-discharge passage for relief of the fuel pressure in the balance chamber 76, a valve 79 for opening and closing the fuel-discharge passage 78, and an actuator for operating the valve 79. The actuator-operated valve 79 is composed of a valve stem 80 extending through the fuel-discharge passage 78 into the balance chamber 76, and a valve face provide at the tip of the valve stem 80 so as to make a contact with a valve seat formed at the ingress of the fuel-discharge passage 78. The actuator-operated valve 79 is made of the valve stem 80 and valve body 81 that are formed integrally with each other.

When the actuator is not energized, a return spring 82 forces the valve stem 80 upwards through a spring shoe 83 while the valve face abuts against its associated valve seat and, therefore, the actuator-operated valve 79 closes the fuel-discharge passage 78. On this event, the high-pressure fuel from the common rail is applied to the fuel sac, shown at 61 in FIG. 5. The fuel in the sac forces the needle valve 75 to the direction of lift. Moreover, the fuel pressure applied to the balance chamber 76 through the fuel passage 77 acts on a pressure-support face 87. At this instant, the resultant force of the spring force of a diaphragm spring 88 and the force of fuel pressure acting on the pressure-support face 87 of the needle valve 75 exceeds the force of fuel pressure applied in the fuel sac, which is exerted on the needle valve 75 to open the discharge orifice, so that the needle valve 75 is held closed to stop the fuel injection out of the discharge orifice.

The instant the actuator is energized, the valve stem 80 is forced downwards in FIG. 7 against the compressed spring force of the return spring 82, moving the valve face of the valve body 81 off its seat, whereby the actuator-operated valve 79 opens the fuel-discharge passage 78. The fuel passage 77 has the effect of a kind of iris, which renders the flow of fuel in the fuel passage 77 smaller than that in the fuel-discharge passage 78. Therefore, opening the fuel-discharge passage 78 results in relieving the balance chamber 76 of the fuel pressure to the space 74. The instant the fuel pressure in the balance chamber 76 is relieved, the force to move the needle valve 75 towards opening overcomes the resultant force of the spring force of the diaphragm spring 88 and the fuel force acting on the pressure-support face 87 of the needle valve 75, which urges the needle valve 75 to the direction of closing. This raises the needle valve 75 off its seat whereby the fuel is injected out of the discharge orifice into the combustion chamber.

On deenergizing the actuator, the valve stem 80 is lifted up by the action of the return spring 82 to close the actuator-operated valve 79. The fuel pressure in the balance chamber 76 is restored by the fuel supply through fuel passage 77 to thereby force downwards the needle valve 75 to close the discharge orifice with the result that the fuel injection ceases. The restored fuel pressure in the balance chamber 76 acts on the valve body 81 and consequently urges, in addition to the force of the return spring 82, the valve face against the its seat. It will be understood that the higher the fuel pressure in the balance chamber is, the greater is the force opening the actuator-operated valve 79, which may be thus kept certainly against the fuel leakage.

In the meantime, the actuator-operated valve 79 for opening and closing the fuel-discharge passage 78 to the balance chamber 76 has been conventionally produced by forming integrally the valve stem 80 with the valve body 81. Such integral forming is preferred for producing the large-sized valves in view of mechanical strength and production cost. Nevertheless, as the actuator-operated valve 79 for the fuel-injection apparatus has the valve stem 80 and valve body 81, which are usually in the range of from about zero point several millimeters to at most several millimeters in their diameter, it becomes much more difficult to achieve the mechanical strength and finish accuracy of the actuator-operated valve 79, which are durable to the recent high-injection pressure.

In integral forming of the valve stem 80 with the valve body 81 of the valve 79, there has been a limit to form the valve stem 80 and valve body 81 slender with high accuracy and, therefore, it could not be helped to make them larger in diameter. For the reasons described above, it has been impossible to make the sufficiently smaller size for the part exposed to the pressure or the area of the pressure-support face of the actuator-operated valve 79. Increase in high fuel-injection pressure causes increase in thrust force exerted from the pressure-support face on valve opening and consequently the valve opening requires the valve-operating power increasing in proportion to the thrust force on valve opening. This inevitably has resulted in using the actuator relatively large in its size, which has caused a major problem in incorporation into the engine.

SUMMARY OF THE INVENTION

The present invention is to overcome the above-described shortcomings to be solved, and to provide an improvement in a fuel-injection apparatus in which the fuel pressure applied to the balance chamber through the fuel passage is relieved by opening the actuator-operated valve in the fuel-discharge passage to control a lift of the needle valve exposed at its pressure-support face to the balance chamber, thereby injecting the fuel out of the discharge orifice upon the lift of the needle valve. The present invention more especially provides an improved fuel-injection apparatus in which the fuel pressure in the balance chamber is used for the valve-closing force upon closure of the actuator-operated valve to keep the fuel against leakage through the actuator-operated valve, while a valve stem and valve body of the actuator-operated valve are formed separately from each other and made slender with resulting in miniaturizing the actuator-operated valve whereby the valve-operating power may be made less upon opening of the actuator-operated valve and consequently the actuator may be made smaller in size.

The present invention relates to a fuel-injection apparatus comprising, a main body provided with discharge orifice for fuel spray, a needle valve arranged in a space in the main body for reciprocating movement so as to open and close at its one end the discharge orifice, a balance chamber in which the opposite end of the needle valve is exposed so as to provide a fuel pressure-exposed surface to control a lift of the needle valve, a fuel path for supplying a fuel pressure into the balance chamber, a fuel-discharge passage for relieving the fuel pressure in the balance chamber, a valve for opening and closing the fuel-discharge passage, and an actuator for operating the valve, the valve being composed of a valve stem extending through the fuel discharge passage into the balance chamber and a valve body attached to one end of the valve stem and having a valve face that is, on valve closing position, in contact with a valve seat formed at an ingress opening of the fuel discharge passage, and both the valve stem and the valve body being formed separately from each other and united with each other.

In the fuel-injection apparatus constructed as described above, when the actuator-operated valve shuts off the fuel-discharge passage, the valve body moves, together with the valve stem extending through the fuel-discharge passage into the balance chamber, towards the egress of the fuel-discharge passage whereby the valve face is brought into a face-to-face contact with the valve seat to close the fuel-discharge passage. At this event, as the fuel pressure in the balance chamber exerts the force to close the actuator-operated valve, the higher the fuel pressure in the balance chamber is, the greater is the force closing the valve. Accordingly, the force sufficient to reseat the valve body to the valve seal may be ensured so that the valve may block certainly the fuel leakage.

In production of the actuator-operated valve, moreover, since the valve stem and the valve body are formed separately from each other, both the valve stem and the valve body may be made less in their diameter with high accuracy whereby the valve fabricated by uniting the valve stem with the valve body is made small in its pressure-exposed area. Consequently, less force may be sufficient for opening the valve upon valve-opening phase, resulting in making it possible to employ the miniaturized actuator less in electric power consumption.

In one aspect of the present invention, an actuator-operated valve is disclosed wherein a reinforcing plate is fixed to both the ends of the valve stem and the valve body by the use of laser-beam welding. The valve body has a central hole in which one end of the valve stem is inserted. Then a reinforcing plate is abutted to both the inserted foremost end of the valve stem and the end face opposite to the valve face of the valve body. All the valve stem, valve body and reinforcing plate are welded together as a unit, preferably, by laser-beam welding. The reinforcing plate is effective for preventing a crack, which might otherwise occur in the valve stem and the valve body.

In another aspect of the present invention, any one of the valve seat and the valve face is formed with concave surfaces for a cancel of pressure. The concave surface is provided for introducing the fuel pressure in the balance chamber thereby to cancel the fuel pressure. Introduction of the fuel pressure into the concave surface on the valve body results in canceling the force that acts in the direction of valve-closing whereby less force may be necessary for pushing the valve to its opening position upon valve-opening phase.

In another aspect of the present invention, the concave surfaces are formed on the valve face of the valve body and composed of an annular grooves and radial grooves extending radially from the annular groove so as to communicate with the balance chamber. The concave surfaces has the configuration of, but not limited to, grooves, which is preferable to make a reliable snugly contact of the valve body against the valve seat as well as protect the valve seat from unbalanced abrasion.

As the fuel-injection apparatus of this invention is constructed as described just above, the higher the fuel pressure in the balance chamber is, the greater is the force closing the actuator-operated valve, which may thus block certainly the fuel leakage flowing out through the valve. This relieves the fuel injection pump from useless working load, thereby improving specific fuel consumption of engines. Face-to-face contact of the valve face with the valve seat makes it easier to preselect the adequate contact pressure occurring between them, thereby eliminating wear of the valve seal. In case the actuator-operated valve is of a poppet valve and, therefore, the valve seat is formed in a tapered concave face in conformity with the valve body of the poppet valve, the valve may operate reliably and speedy due to the snug fitting of the confronting tapered faces, even if the turbulence eddy flow happens in fuel flow. On the closure position, the reliable sealing may be established between the valve face and the valve seat to prevent certainly the fuel leakage.

Moreover, the balance chamber is defined by the recess in the control member while the fuel-discharge passage is also formed in the same control member, whereby the intake and discharge means for the fuel pressure to drive the needle valve may be concentrated on the control member. This is convenient for structure, production and assembly of the fuel-injection apparatus. Forming the fuel passages at the interfaces of the control member and the nozzle body, further, provides the fuel passages by the use of the counterpart of the interfaces, resulting in improving the workability. Moreover, the return spring to bias the needle valve towards its position for closing the discharge orifice is contained in the space in the control member whereby the fuel-injection apparatus may be made compact in size. Adoption of the structure as described above may contribute to production cost saving.

DETAILED DESCRIPTION OF THE PREFERRED EMBODIMENTS

Figure 1:
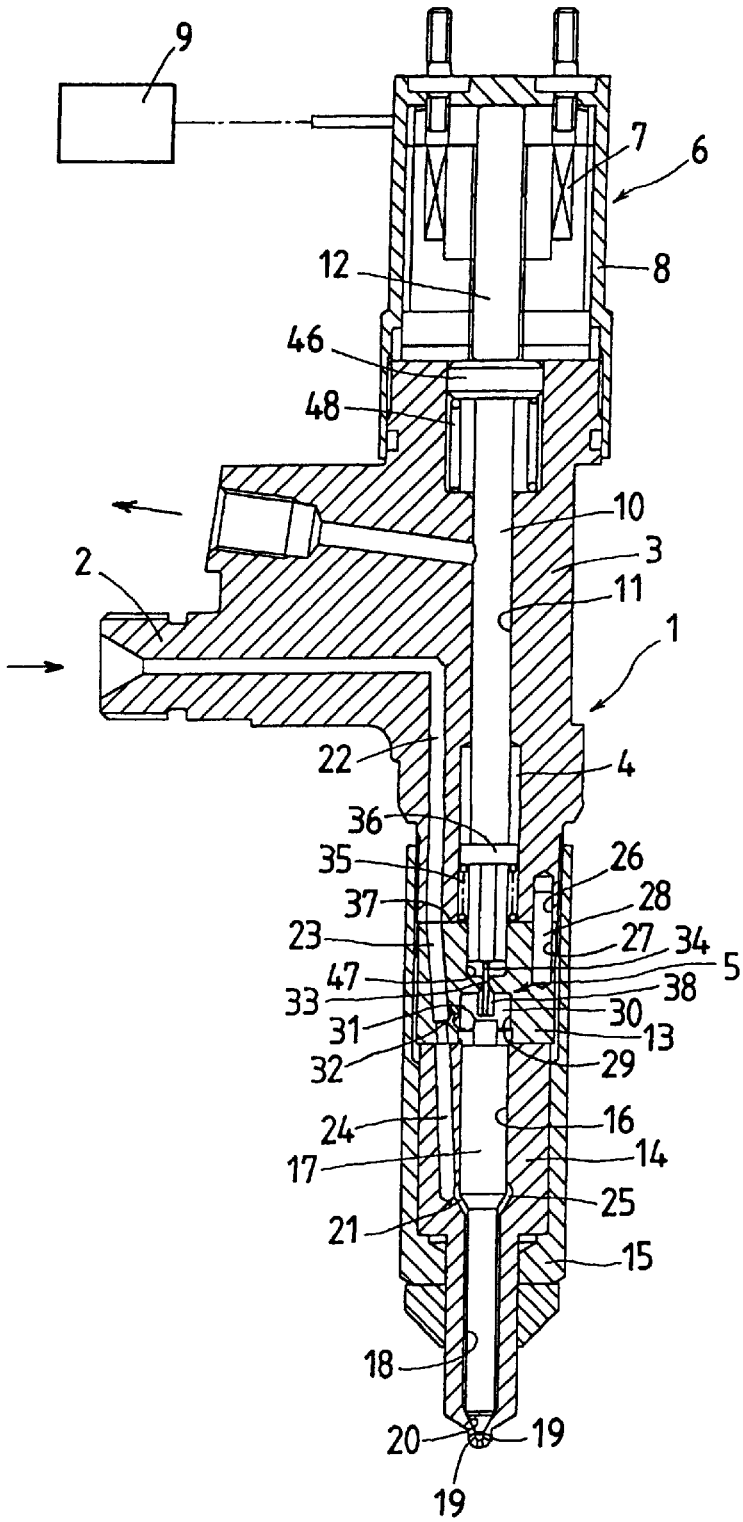
FIG. 1 is an axial sectional view showing an embodiment of a fuel-injection apparatus according to the present invention.

Referring now in detail to the drawings, a preferred embodiment of the fuel-injection apparatus according to the present invention will be explained below. This fuel-injection apparatus is suitably applicable to the common rail, fuel-injection system or pressure-accumulated, fuel-injection apparatus, not shown in the drawing. The fuel fed in an accumulator, referred to as "common rail" hereinafter, by a fuel injection pump is intensified in pressure in the common rail to the high pressure fuel, which is in turn charged out of injection nozzles of the fuel-injection apparatus into combustion chambers.

An injector body 1 of the fuel-injection apparatus, shown in FIG. 1, is hermetically attached in a bore, not shown in figures, provided in a base such as a cylinder head through a sealing member. The injector body 1 is hermetically mounted at the lower end thereof with a nozzle while at the upper shoulder thereof with a high-pressure fuel inlet 2. The injector 1 includes a middle section 3 provided therein with a space 4 extending axially of the injector 1. Arranged in the space 4 is a valve 5 for opening and closing a fuel-discharge passage 33, which will be described below. The valve 5 is designed to be driven by an actuator 6 having an electromagnet 7, which is accommodated in the injector body 1 with a fixing cap 8 screwed on the middle section 3. The electromagnet 7 operates in response to control signals issued from a control unit 9 to drive the valve towards its open position or downwards in FIG. 1.

Motion of a plunger 12 with the electromagnet 7 is transmitted to an output shaft 10, one end of which is formed with a flange 46, while the opposite end is connected to the actuator-operated valve 5. The output shaft 10 extends for sliding movement through a guide bore 11 reduced radially with respect to the space 4 in the middle section 3, and a guide recess 47 in a control member 13, which will be explained below. A return spring 48 is installed between the flange 46 and a stepped upper edge of the guide bore 11 to urging the output shaft 10 axially upwards. The output shaft 10 may make a high-speed axial reciprocating movement under the operation of the electromagnet 7.

The control member 13 is arranged interposed between the middle section 3 and a nozzle body 14. Both the control member 13 and the nozzle body 14 are united together to the middle section 3 to constitute a part of the injector body 1 by screwing a threaded cap 15, engaged with the nozzle body 14, onto the mating portion of the middle section 3. The nozzle body 14 is provided therein with a nozzle bore 16 in which a needle valve 17 is inserted for sliding movement so as to provide an annular clearance 18 therebetween. The clearance around the needle valve 17 forms a high-pressure fuel passage. The nozzle body 14 is formed at its tip with a discharge orifice 19 through which the fuel is injected into the combustion chambers of the internal combustion engine. The needle valve 17 has a tapered end. Axial reciprocating motion of the needle valve 17 causes the its tapered end to raise off and to reseat on a confronting tapered surface 20 at the tip of the nozzle bore 16 in the nozzle body 14, whereby the fuel flow to be injected out of the discharge orifice 19 may be allowed and blocked. The needle valve 17 has at the midway area thereof an annular tapered surface 21 that forms a pressure-exposed surface for bearing the fuel pressure acting in the direction where the needle valve 17 opens the discharge orifice. The instant the needle valve 17 is raised off the tapered surface 20, the high-pressure fuel may be injected out of the discharge orifice 19 into the combustion chamber. In contrast, when the needle valve 17 moves back down onto the tapered surface 20, the fuel flow is blocked and thus the fuel injection ceases.

The fuel fed from the common rail for the high-pressure supply source to the fuel inlet 2 flows through a fuel passage 22 in the injector body 1, a fuel passage 23 in the control member 13 and a fuel passage 24 in the nozzle body 14, and reaches the fuel sac 25 to which is exposed the tapered surface 21 for the pressure-exposed surface. The instant the needle valve 17 opens the discharge orifice 19, the fuel in the sac 25 may be injected out of the discharge orifice 19.

Figure 2:
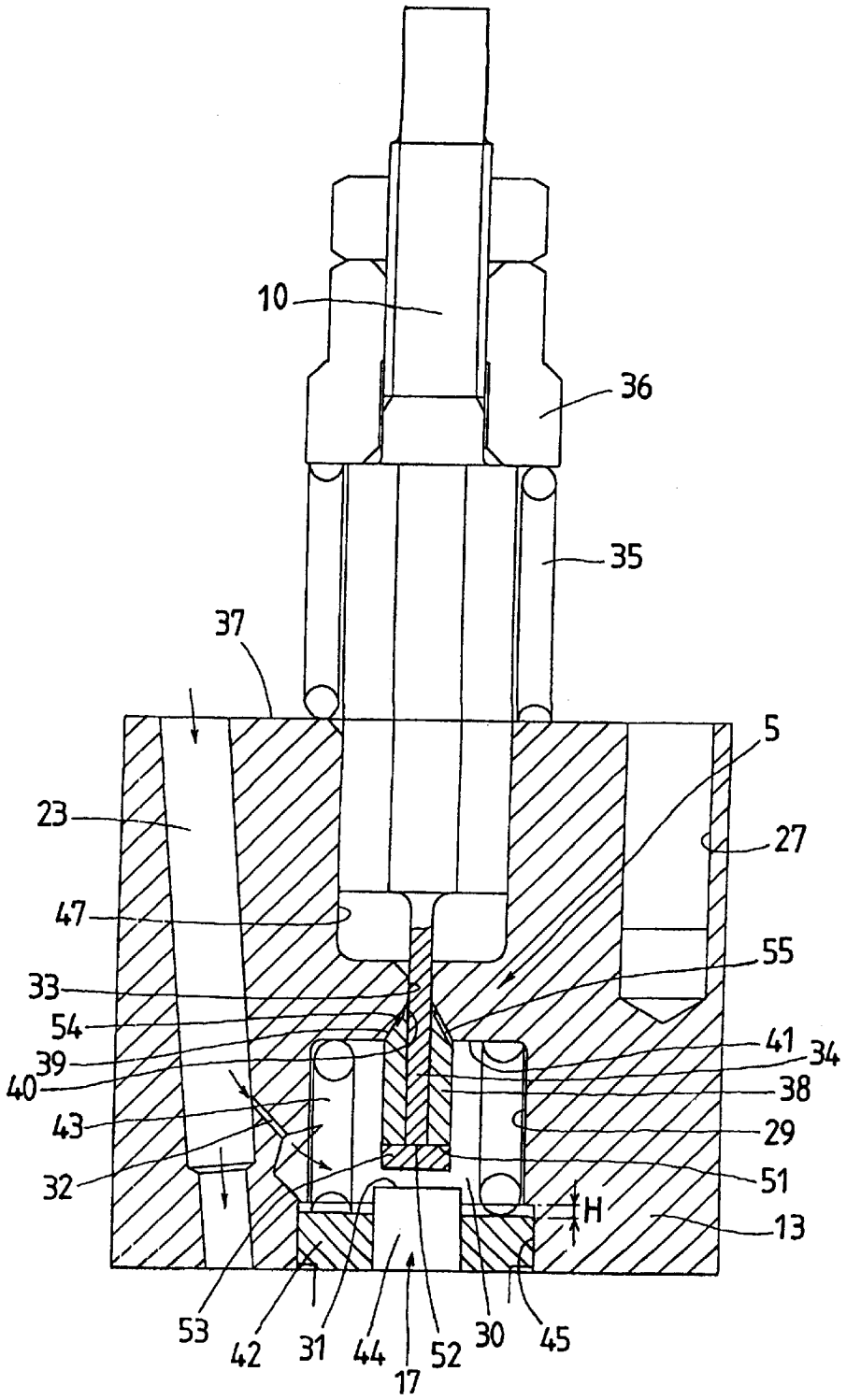
FIG. 2 is a fragmentary axial sectional view showing the essential parts of the fuel-injection apparatus shown in FIG. 1.

As shown in detail in FIG. 2, the control member 13 has a hole 27 that is at the position offset radially outwardly with respect to the center thereof and in alignment with a hole 26 in the injector body 1. A connector pin 28, shown in FIG. 1, is inserted in the confronting holes 26, 27 to thereby keep the control member 13 in proper position relatively of the middle section 3. The control member 13 is further provided with a recess 29 opened facing to the nozzle body 14. The needle vale 17, explained in detail hereinafter, extends into the recess 29 and has at its end a pressure-exposed surface 31 to the fuel pressure, which cooperates with the recess 29 to define the balance chamber 30. The control member 13 is bored with a fuel path 32, which is open to the fuel passage 23 and extends slantwise radially to the center of the control member 13. The fuel path 32 communicates with the balance chamber 30 to feed the high-pressure fuel into the chamber 30. The fuel-discharge passage 33 is bored axially at the center of the control member 13 so as to communicate at one end thereof with the balance chamber 30 and at the opposite end with the axially extending space 4 in the middle section 3.

The actuator-operated valve 5 includes a valve stem 34 connected integrally with the output shaft 10 of the actuator 6, and a valve body 38 bonded with one end of the valve stem 34 by laser-beam welding. The valve stem 34 and the valve body 38 constitute, respectively, the valve stem and valve body structures according to this invention. A return spring 35 of coil spring is abutted at its end against a spring bearing 36 fixed to the output shaft 10 and at the opposite end against a top face 37 of the control member 13. The return spring 35 is fitted under compression to urge constantly the valve stem 34 upwards, that is, the return spring 35 forces the actuator-operated valve 5 to the closure position.

The valve stem 34 extends through the fuel-discharge passage 33, leaving a small clearance therebetween, into the balance chamber 30. The valve stem 34 has at its end the valve body 38 to open and close the fuel-discharge passage 33.

Figure 3:
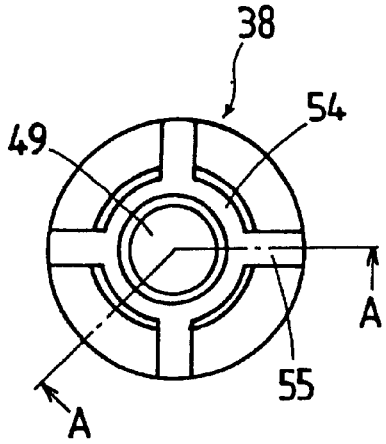
FIG. 3 is a plan view showing a valve body of an actuator-operated valve.
Figure 4:
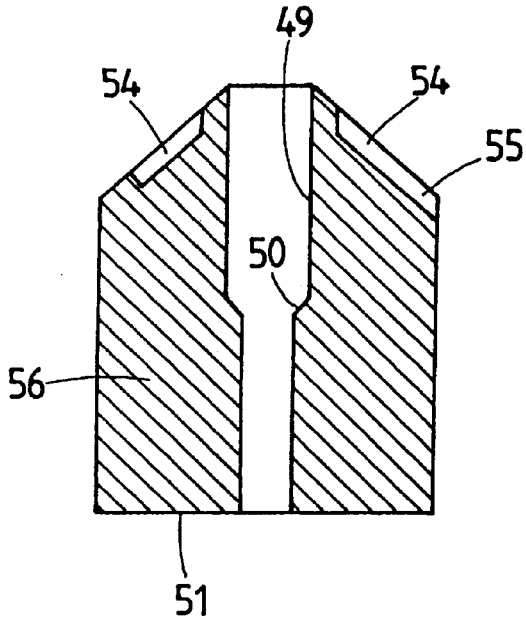
FIG. 4 is a sectional view taken along the line A—A of FIG. 3.
Figure 5:
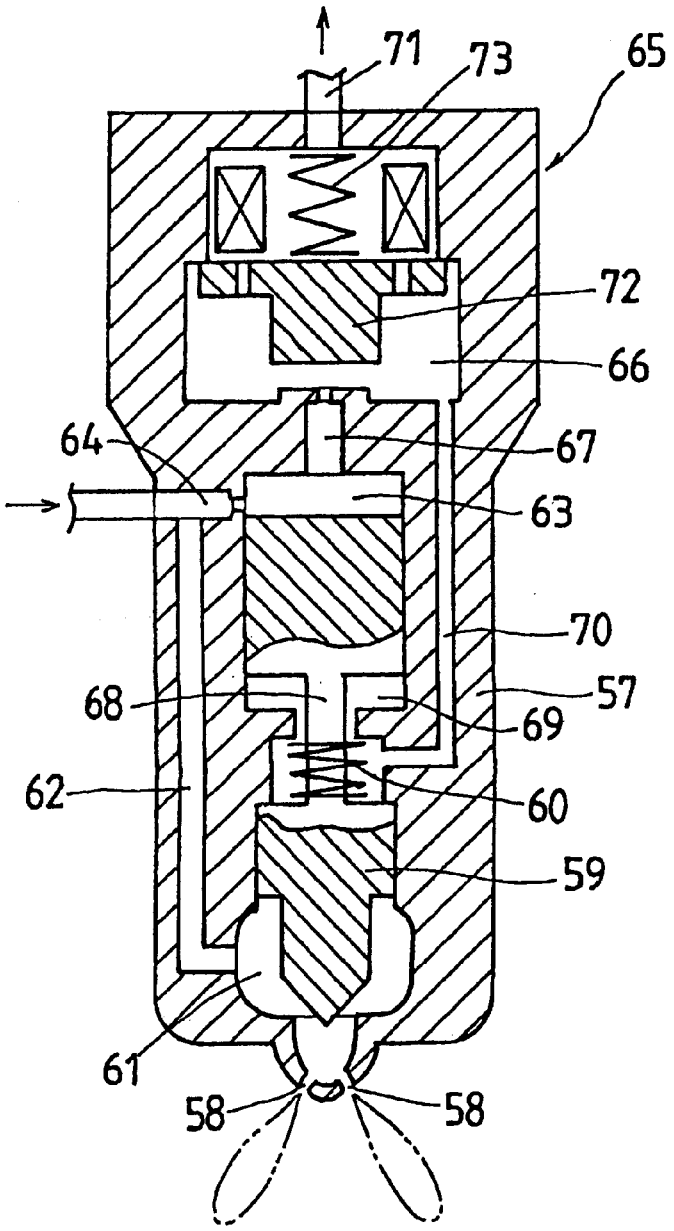
FIG. 5 (PRIOR ART)
FIG. 5 is a schematic axially sectioned view illustrating a conventional fuel-injection apparatus.
Figure 6:
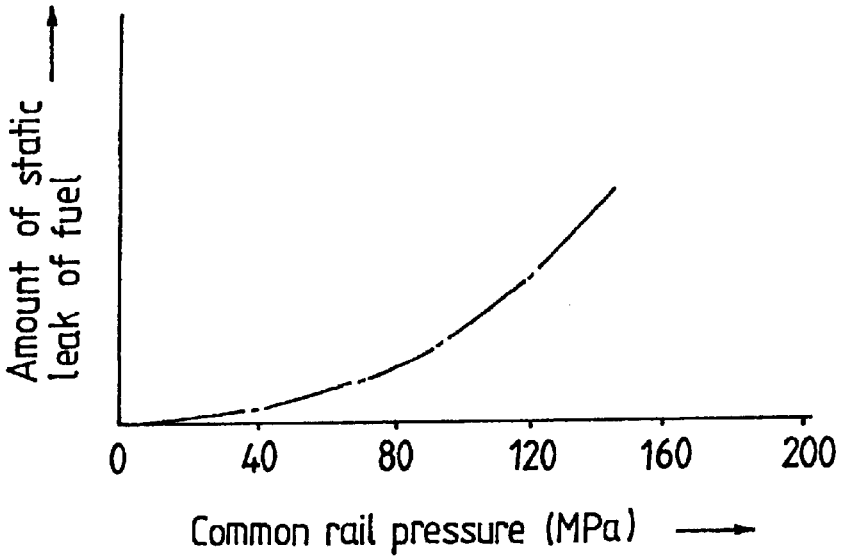
FIG. 6 (PRIOR ART)
FIG. 6 is a graphic representation of common rail pressure versus amount of static leak of fuel.
Figure 7:
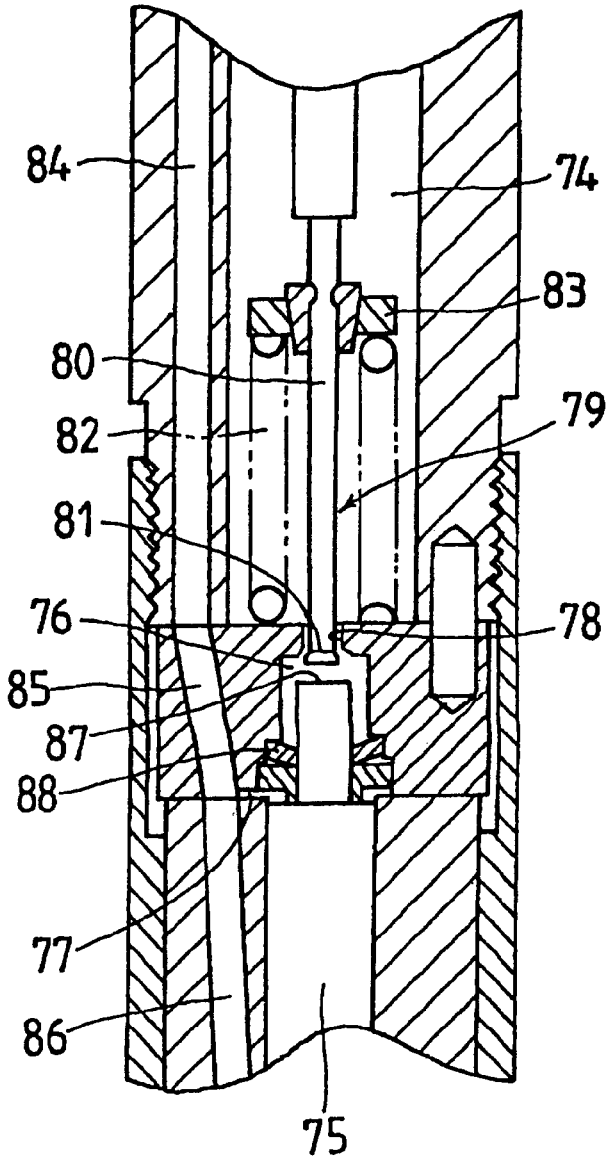
FIG. 7 (PRIOR ART)
FIG. 7 is a fragmentary axially sectioned view showing the essential parts of another conventional fuel-injection apparatus.

Referring to FIGS. 3 and 4, the valve body 38 is provided with a central hole 49 having at the midway portion thereof a tapered step 50. The valve stem 34 and the valve body 38 are formed separately from each other. In assembly, the valve stem 34 is forced into the central hole 49 of the valve body 38 till the slender nose of the valve stem 34 abuts against the tapered step 50, where a bottom end 52 of the valve stem 34 is positioned in flush with a bottom surface 51 of the valve body 38. The assemblage of the valve 5 finishes with laser-beam welding a reinforcing plate 53 to the bottom end 52 of the valve stem 34 and the bottom surface 51 of the valve body 38. The reinforcing plate 53 is provided for protecting the valve stem 34 and valve body 38 against the high pressure, which might be otherwise cracked under the high pressure. The valve stem 34 and the valve body 38 may be made less in diameter because they are formed separately. This contributes to miniaturization of the actuator-operated valve itself, resulting in reducing the fuel pressure acting on the valve 5.

The valve body 38 has a tapered conical valve face 39 on a cylindrical major portion 56. The valve face 39 is in complementary with a valve seat 40 of a conical convex surface, which is formed in the fuel-discharge passage 33 at its end opened facing to the balance chamber 30. The valve face 39 is formed with an annular groove 54 concentric with the central hole 49, and radial grooves 55 arranged spaced from each other with a fixed angles and extended radially outwardly from the annular groove 54. Namely, the radial grooves 55 are arranged symmetric with respect to the center of the valve body 38. The radial grooves 55 communicate the annular groove 54 with the balance chamber 30 to introduce the fuel pressure in the balance chamber 30 to the annular groove 54. The fuel pressure in the annular groove 54 acts on the valve body 38 so as to depress the valve body 38, thereby counteracting the force pressing the valve body 38 against the valve seat 40. Consequent less force to depress the valve body 38 upon valve opening may be sufficient, so that the miniaturized actuator may provide satisfactory effects.

When the electromagnet 7 is in nonconductive state or deenergized, the actuator-operated valve 5 is held by the elastic action of the return spring 35 in closing state where the valve face 38 of the valve body 39 seats against the valve seat 40 in face-to-face contact relation, thereby blocking the fuel-discharge passage 33. With the electromagnet 7 in energization by the application of electricity, the valve stem 34 of the valve 5 moves downwards in FIG.1, overcoming the elastic forces of the return springs 35, 48. This forces the valve face 39 of the valve body 38 off its valve seat 40 to open the fuel discharge passage 33 at its end of the balance chamber 30, causing the flow of fuel whereby the fuel pressure in the balance chamber 30 is relieved to the space 4 through the clearance between the confronting fuel-discharge passage 33 and the valve stem 34.

A coil spring 43 for return spring is interposed under compression between a bottom wall 41 of the recess 29 and a spring bearing 42 attached to the axial end 44 of the needle valve 17. The coil spring 43 forces the needle valve 17 to its closure position where the needle valve 17 blocks the fuel flow to the discharge orifice 19. The force of the fuel pressure in the balance chamber 30 acting on the pressure-exposed surface 31 of the needle valve 17 may control the lift of the valve body 38 under balance with the fuel pressure exerted on the pressure-exposed surface of the tapered portion 21 of the needle valve 17 and the return force of the coil spring 43 acting on the needle valve 17. The recess 29 in the control member 13 is partially enlarged to provide a shoulder 45 for accommodate the spring bearing 42. The shoulder 45 is formed larger in depth by a distance H, compared to the thickness of the spring bearing 42. The distance H is equal to a distance spanning from the closure position to the open position of the needle valve 17, which may be thus movable within the range of between the closure and open positions.

Since the effective open area provided by moving the valve face 39 of the valve body 38 off the valve seat 40 is designed less than the cross-sectional area of the clearance between the fuel-discharge passage 33 and the valve stem 34 over almost all operating range of the valve 5, the open degree of the actuator-operated valve 5 upon opening the fuel-discharge passage 33 defines the extent of reduction of the fuel pressure in the balance chamber 30.

The following explains as to the operation of the embodiment constructed as described just above. With the electromagnet 7 being deenergized, the return spring 35, as shown in FIG. 2, forces the valve stem 34 through the spring bearing 36 upwards in the drawings, whereby the valve face 39 of the valve body 38 seats against the valve seat 40 so that the actuator-operated valve 5 shuts off the fuel-discharge passage 33. In this event, the high-pressure fuel fed from the common rail is supplied from the high-pressure fuel inlet 2 to the fuel sac 25 through the fuel passages 22, 23 and 24. The fuel in the sac 25 acts on the tapered surface 21 of the needle valve 17, which is thus urged towards the direction of lift. The fuel reaches the clearance 18 defined between the nozzle body 14 and the periphery of the needle valve 17 thereby to fill the clearance 18. Moreover, the fuel pressure, which is charged in the balance chamber 30 through the fuel passage 32, acts on the pressure-exposed surface 31 of the needle valve 17. Under this phase, the resultant force of the return force of the coil spring 43 with the force of the fuel pressure acting the pressure-exposed surface 31 to force the needle valve 17 to its closing position exceeds the force of the fuel pressure acting on the pressure-exposed surface of the tapered surface 21 to force the needle vale 17 to its open position and, therefore, the needle valve 17 closes the discharge orifice 19 whereby the fuel injection ceases.

The instant the controller unit 9 energizes the electromagnet 7, the valve stem 34 is forced downwards in FIG. 1 against the compression spring force of the return spring 35 to move the valve face 39 of the valve body 38 off the valve seat 40 whereby the valve 5 opens the fuel-discharge passage 33. The fuel path 32 has the effect of an iris, which renders the flow of fuel in the fuel path 32 smaller than that in the fuel-discharge passage 33. Therefore, opening the fuel-discharge passage 33 relives the fuel pressure in the balance chamber 30 to the space 4. Upon relief of the fuel pressure in the balance chamber 30, the force of the fuel pressure acting on the tapered surface 21 to force the needle valve 17 to its open position overcomes the resultant force of the return force of the coil spring 43 with the force of the fuel pressure acting the pressure-exposed surface 31 to force the needle valve 17 to its closing position to thereby lift the needle vale 17 so that the fuel is injected out of the discharge orifice 19 into the combustion chambers. As the effective open area of the fuel-discharge passage 33 opened by the actuator-operated valve 5 is designed less than the cross-sectional area of any other fuel-discharge passages after the balance chamber 30, the open degree of the actuator-operated valve 5 defines the magnitude of the fuel pressure in the balance chamber 30.

The instant the control unit 9 ceases the supply of electric current to the electromagnet 7, the return spring raises the valve stem 34 to close the actuator-operated valve 5. The balance chamber 30 is applied the fuel pressure from the fuel path 32 thereby restoring the fuel pressure therein and, consequently, the needle valve 17 stops the fuel injection. The restored fuel pressure acts on the valve body 38 to consequently urge, in addition to the force of the return spring 35, the valve face 39 against the its seat 40. It will be understood that the higher the fuel pressure in the balance chamber 30 is, the greater is the force closing the actuator-operated valve 5, which may thus block certainly the fuel leakage.

According to the fuel-injection apparatus of the present invention, the valve face 39 is formed with the annular groove 54 concentric with the central hole 49, and the radial grooves 55 extended radially outwardly from the annular groove 54, whereby the fuel pressure in the balance chamber 30 is introduced into the annular groove 54. The fuel pressure in the annular groove 54 acts on the valve body 38 so as to open the actuator-operated valve 5 and, consequently, the valve 5 is easier to open, compared to the prior injectors. This makes it possible to adopt the miniaturized actuator 6 in which less electric power may be sufficient.

In the embodiment described above, although both the valve stem 34 and the valve body 38 are integrally united to the actuator-operated valve 5 by the laser-beam welding through the reinforcing plate 53, the laser-beam welding is not necessarily required and, for example, another assemblage may be employed of press-fitting the valve stem 34 into the valve body 38 and caulking the end of the valve stem. Further, the actuator 6 for the valve 5 may be of piezoelectric element, instead of the electromagnet 7 adopted exemplarily in the embodiment described above. The actuator 6 of piezoelectric element may achieve the rapid operation of the start and stop of the fuel injection with less response lag even the fuel injection cycle is very short in period. Moreover, as the effective open area provided in the fuel-discharge passage by moving the valve body of the actuator-operated valve 5 off the valve seat is less than the minimum cross-sectional area of the clearance between the fuel-discharge passage 33 and the valve stem 34, the open degree of the actuator-operated valve 5 may affect the magnitude of the fuel pressure relieved from the balance chamber 30. As the operations of the actuator-operated valve 5 may be altered by changing the timing, conductive duration and voltage of the electric current applied to the piezoelectric element, changing the lift speed of the needle valve 17 in accordance with the engine operating conditions may ensure various fuel-injection rating characteristics, in particular, initial fuel-injection rating characteristics with stability, resulting in reducing NOx emission and noise level.

It should be understood that the foregoing relates to only preferred embodiments of the present invention, and that is intended to cover all changes and modifications of the examples of the invention herein chosen for the purposes of the disclosure, which do not constitute departure from the spirit and scope of the invention.

What is claimed is:

1. A fuel-injection apparatus comprising, a main body provided with discharge orifice for fuel spray, a needle valve arranged in a space in the main body for reciprocating movement so as to open and close at its one end the discharge orifice, a balance chamber in which the opposite end of the needle valve is exposed so as to provide a fuel pressure-exposed surface to control a lift of the needle valve, a fuel path for supplying a fuel pressure into the balance chamber, a fuel-discharge passage for relieving the fuel pressure in the balance chamber, a valve for opening and closing the fuel-discharge passage, and an actuator for operating the valve, the valve being composed of a valve stem extending through the fuel discharge passage into the balance chamber and a valve body attached to one end of the valve stem and having a valve face that is, on valve closing position, in contact with a valve seat formed at an ingress opening of the fuel discharge passage, and both the valve stem and the valve body being formed separately from each other and united with each other, wherein the valve stem extends axially through the valve body, so that both end faces the valve stem and valve body are flush with one another, and a reinforcing plate is fixed by welding to the flush end faces.

2. A fuel-injection apparatus comprising, a main body provided with discharge orifice for fuel spray, a needle valve arranged in a space in the main body for reciprocating movement so as to open and close at its one end the discharge orifice, a balance chamber in which the opposite end of the needle valve is exposed so as to provide a fuel pressure-exposed surface to control a lift of the needle valve, a fuel path for supplying a fuel pressure into the balance chamber, a fuel-discharge passage for relieving the fuel pressure in the balance chamber, a valve for opening and closing the fuel-discharge passage, and an actuator for operating the valve, the valve being composed of a valve stem extending through the fuel discharge passage into the balance chamber and a valve body attached to one end of the valve stem and having a valve face that is, on valve closing position, in contact with a valve seat formed at an ingress opening of the fuel discharge passage, and both the valve stem and the valve body being formed separately from each other and united with each other, wherein any one of the valve seat and the valve face is formed with concave surfaces for a cancel of pressure.

3. A fuel-injection apparatus as defined in claim 2, wherein the concave surfaces are formed on the valve face of the valve body and composed of an annular grooves and radial grooves extending radially from the annular groove so as to communicate with the balance chamber.

* * * * *